US005482375A

United States Patent [19]

Richardson et al.

[11] Patent Number: 5,482,375

[45] Date of Patent: Jan. 9, 1996

[54] TUBULAR PLASTIC END STOPS BONDED TO PLASTIC ZIPPER

[75] Inventors: Dale S. Richardson, Westerville; Roger W. Smith, Grove City, both of Ohio

[73] Assignee: Mobil Oil Corporation, Fairfax, Va.

[21] Appl. No.: 342,321

[22] Filed: Nov. 18, 1994

Related U.S. Application Data

[62] Division of Ser. No. 155,365, Nov. 22, 1993, Pat. No. 5,405,478.

[51] Int. Cl.[6] ..... B65D 33/25

[52] U.S. Cl. ..... 383/64; 24/435; 24/436

[58] Field of Search ..... 383/63, 64, 65; 24/388, 399, 400, 435, 436

[56] References Cited

U.S. PATENT DOCUMENTS

| | | | |
|---|---|---|---|
| 3,790,992 | 2/1974 | Herz | 24/400 |
| 4,637,060 | 1/1987 | Ausnit | 383/63 X |
| 4,890,935 | 1/1990 | Ausnit et al. | 383/64 X |
| 5,067,208 | 11/1991 | Herrington, Jr. et al. | 24/400 |
| 5,131,121 | 7/1992 | Herrington, Jr. et al. | 24/400 X |
| 5,161,286 | 11/1992 | Herrington, Jr. et al. | 24/435 X |
| 5,405,478 | 4/1995 | Richardson et al. | 24/436 X |

*Primary Examiner*—Jes F. Pascua

*Attorney, Agent, or Firm*—Alexander J. McKillop; Malcom D. Keen; L. Gene Wise

[57] ABSTRACT

Plastic-film zipper bags having tubular plastic end stops bonded to the plastic zipper to seal the ends of the zipper and to provide stops to retain a slider on the zipper are disclosed. Also disclosed is a method of installing the tubular plastic end stops on the zipper.

3 Claims, 2 Drawing Sheets

TUBULAR PLASTIC END STOPS BONDED TO PLASTIC ZIPPER

This is a division of application Ser. No. 08/155,365, filed Nov. 22, 1993, now U.S. Pat. No. 5,405,478.

BACKGROUND OF THE INVENTION

The present invention relates to improvements in plastic reclosable fasteners or zippers with sliders for opening and closing the zippers on plastic-film bags and the like and particularly to the provision of plastic end stops at the ends of the plastic zipper to seal the ends of the zipper and to provide stops to retain the slider on the zipper.

Plastic reclosable fasteners or zippers with sliders are well known in the art. The plastic zippers include a pair of male and female fastener elements in the form of reclosable interlocking rib and groove profile elements for cooperation with a slider for opening and closing the rib and groove elements. In the manufacture of plastic-film bags, a pair of these male and female plastic profile elements extend along the mouth of the bag and are secured in any suitable manner to the flexible walls of the plastic-film bag. These zipper elements may be integral marginal portions of such walls or they may be extruded separately and thereafter attached to the walls along the mouth of the bag.

Various arrangements have been utilized heretofore to prevent the slider from sliding off either end of the zipper. In one of the more conventional arrangements, the slider includes a separator finger that extends down between the integral locking rib and groove elements as the slider is moved from one edge of the bag to the other edge of the bag. When this bag is opened, the slider is stopped by the side seam at the edge of the bag the separator finger comes into contact with it. This prior art is described in U.S. Pat. No. 3,790,992—Herz. In that patent there is disclosed an arrangement wherein the heat seals that join the rib and groove elements are made wider at one edge than at the second edge of the bag and the wider seal is of a width at least equal to the length of the slider from its closing end to the separator finger so that the slider remains fully on the bag at the end of its travel when the bag is opened. The patent states that these seal areas provide stops for the slider. A second arrangement for providing stops for a slider at the ends of the zipper is disclosed in U.S. Pat. No. 3,259,951—Zimmerman. In this patent, opposing interlocking or mating strips are permanently joined or sealed to each other at the ends with a separate stop member sealed between these members to stop the longitudinal movement of the slider therealong. Another arrangement is described in U.S. Pat. No. 5,088,971—Herrington and in U.S. Pat. No. 5,131,121—Herrington et al which disclose end stops that are created from existing material of the profile rib and groove elements at the opposite ends of the reclosable fastener, and that protrude transversely from the fastener a distance adequate to engage the sides of the slider and thus prevent movement of the slider past the respective ends of the bag. With this arrangement, the size of the end stops is limited by the volume of material available in the ends of the rib and groove elements. Another prior art arrangement is described in U.S. Pat. No. 5,161,286—Herrington et al. In this patent end clamp members are located at the opposite ends of the reclosable fastener. A pair of end clamp members is connected together by a flexible strap which extends over the top of the zipper and by a rivet that extends through the pair of end clamp members and the sidewalls of the bag below the profile rib and groove elements of the zipper to secure the end clamp members to the bag.

It would be desirable to provide plastic bags with zipper closures wherein the zipper is terminated by the addition of plastic end stops which are bonded to the zipper and thus create a stronger seal. The use of such tubular end stops also provides for ease in assembly of the end stops with the zipper.

RELATED APPLICATION

Fused Plastic End Clips for Zippers are disclosed in the related application entitled "Plastic End Clips Fused to Plastic Zipper" Ser. No. 08/074,576, filed Jun. 10, 1993 by Fox J. Herrington and assigned to the same assignee as the present application.

SUMMARY OF THE INVENTION

It is an object of the present invention to provide a plastic-film bag having a plastic zipper with improved means for attaching the ends of the two zipper elements together so that they are secured in a strong and leakproof manner and are capable of retaining a slider on the zipper. The present invention relates to the manufacture of plastic-film bags and the like having a reclosable fastener extending along the mouth of the bag and a slider straddling the fastener for opening and closing the fastener, the fastener comprising a pair of flexible plastic strips on the facing sidewalls of the bag and having reclosable interlocking rib and groove profile elements on the respective strips. The improved method of providing end stops for the slider and of terminating the reclosable fastener comprises end stop means located at the opposite ends of the profile elements on the reclosable fastener, each of the end stop means comprising a length of slit plastic tubing extending over one end of the reclosable fastener and locked into position on the ends of the profile elements by deformations impressed by heat, ultrasonic energy, or the like through the wall of the tubing and into the profile elements to bond the tubing in sealed relation with the ends of the profile elements, the tubing projecting outwardly from the profile elements and being engageable with the slider for preventing the slider for moving past the ends of the reclosable fastener.

The present invention also relates to the method of manufacturing plastic-film bags and the like having a reclosable fastener along the mouth of the bag and a slider straddling the fastener for opening and closing the fastener, the fastener comprising a pair of flexible plastic strips on the facing sidewalls of the bag and having reclosable interlocking rib and groove profile elements on the respective strips. The present invention provides an improvement in a method of applying end stops for the slider and of terminating a reclosable fastener comprising the steps of preparing predetermined lengths of slit plastic tubing, feeding the predetermined lengths of slit plastic tubing along a guide to an assembly station, feeding continuous plastic material for bags having reclosable interlocking rib and groove profile elements extending along the mouth of the bag material to the assembly station, positioning the slit in the plastic tubing so that a length of the tubing can pass over the interlocked profiles of the reclosable fastener on the continuous bag material which moves therebeneath, at a clamp-bonding station, positioning the length of the slit plastic tubing with respect to the separation line of the preceding bag in the continuous bag material, clamping and bonding the split plastic tubing into locked position on the interlocked profiles of the reclosable fastener, and simultaneously narrowing the tubing intermediate the ends at a location where the edges of the adjacent bags are to be heat sealed and cut apart in a subsequent operation.

DESCRIPTION OF THE PREFERRED EMBODIMENT

Figure 1:
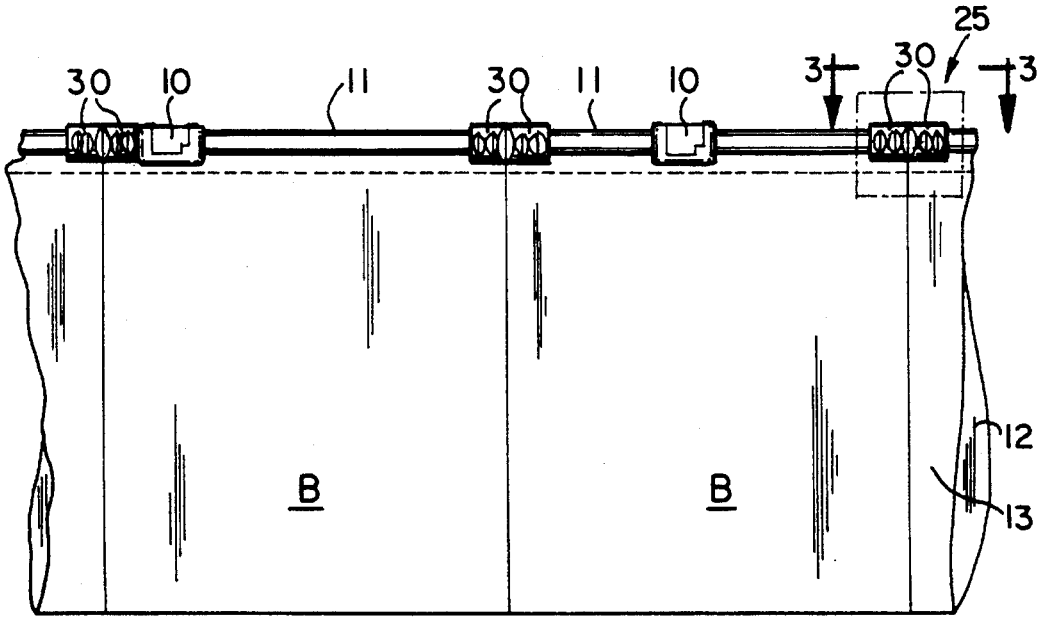
FIG. 1 is an elevational view of a series of plastic bags manufactured in accordance with the present invention.

Referring to FIG. 1 there is illustrated a series of plastic-film bags B each having a plastic slider 10 and a profiled plastic reclosable fastener or zipper 11 with tubular end stops 30 embodying the present invention. The slider 10 and zipper 11 are particularly suited for plastic-film bags and the like. Various types of sliders and zippers may be used with the new tubular end stops. By way of example, the slider 10 may be of the type disclosed and claimed in U.S. Pat. No. 5,067,208—Herrington et al entitled "Plastic Reclosable Fastener with Self-Locking Slider" and the zipper 11 may be of the type disclosed and claimed in U.S. Pat. No. 5,007,143—Herrington entitled "Rolling Action Zipper Profile and Slider Therefor". As shown in FIG. 1, the slider 10 is assembled on the zipper 11 at the upper edge or mouth of the plastic-film bag B. The bag B may be made of any suitable plastic film such for example as polyethylene, polypropylene, or similar material. The zipper 11 preferably is made from the same plastic material as the bag B. The bag B is formed by a pair of flexible plastic sheets 12 and 13 joined at the bottom and having an upper edge with the profile plastic reclosable fastener 11 extending along the length thereof and having reclosable interlocking rib and groove profile elements 14 and 15 on the facing surfaces thereof. In the manufacture of plastic-film bags, a pair of male and female fastener elements 14 and 15 extend along the mouth of the bag and these (interlocking rib and groove profiles) elements are adapted to be secured in any suitable manner to the flexible walls of the plastic-film bags. Plastic-film bags with reclosable fastener elements such as 14 and 15 are well known in the art. For example, see the aforesaid patents referred to herein.

The slider 10 straddles the zipper 11 at the top of the bag B and is adapted for opening or closing the reclosable fastener elements 14 and 15 of the zipper 11. The slider 10 moves along the zipper 11 from one end to the other and includes a separator finger (not shown) which cooperates with the elements 14 and 15 to open and close the zipper. The slider 10 may be molded from any suitable plastic such for example as nylon, polypropylene, polystyrene, Delrin, or ABS.

Referring to FIG. 1 it will be seen that the opposite ends of the zipper 11 are provided with end stops 30, 30. Each of the end stops 30 is identical and each end stop 30 comprises a length of slit plastic tubing extending over one end of the reclosable fastener and locked into position on the ends of the profile elements by deformations impressed through the wall of the tubing and into the profile elements to bond the tubing in sealed relation with the ends of the profile elements. The tubing projects outwardly from the profile elements and is engageable with the slider 10 for preventing the slider 10 from moving past the ends of the reclosable fastener 11.

Figure 2:
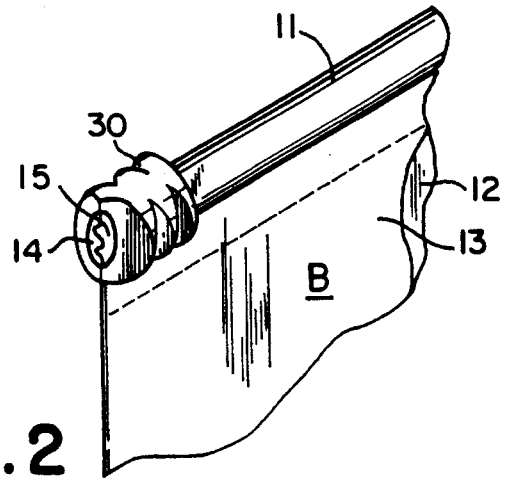
FIG. 2 is a perspective view of a tubular end stop installed on one end of a zipper of a plastic bag embodying the present invention.
Figure 3:
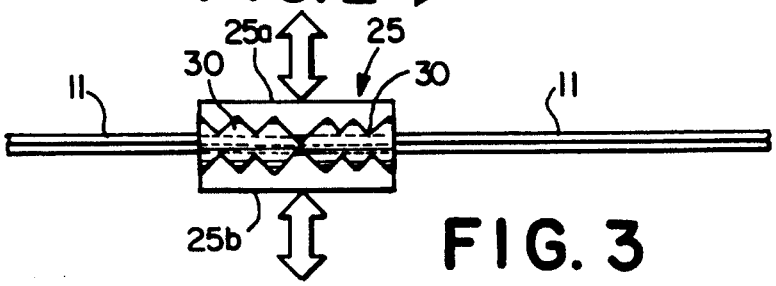
FIG. 3 is a top plan view taken along the lines 3—3 in FIG. 1.
Figure 4:
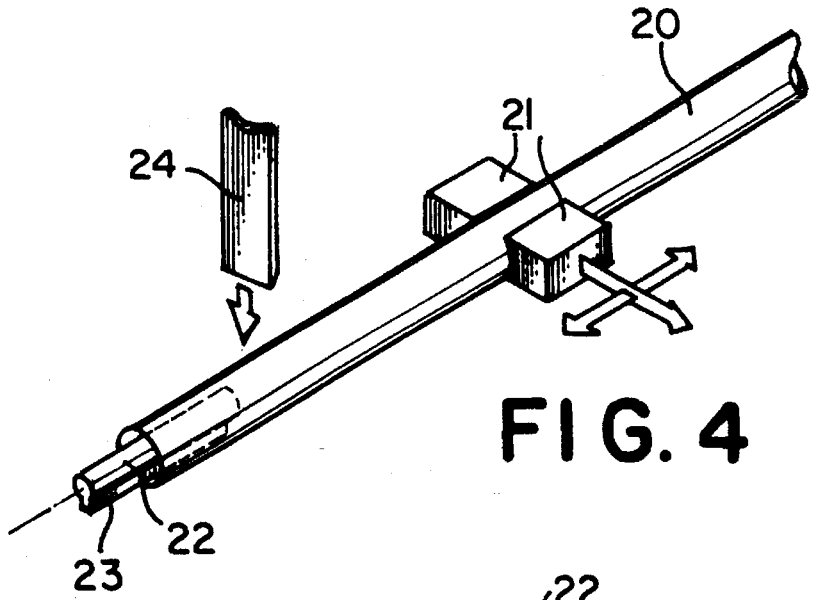
FIG. 4 is a perspective view illustrating the preparation of predetermined lengths of slit tubing for use in the manufacture of tubular end stops for plastic bags in accordance with the present invention.

As shown in FIG. 2 in a completed bag B the end stop 30 has been severed from the adjacent end stop shown in FIGS. 1 and 3. In FIGS. 1 and 3 there is illustrated a pair of end stops 30 that form the right end of one bag and the left end of the adjacent bag in the bag line as the bags are being manufactured. For ease of manufacture of the bags, the end stops 30 on adjacent bags are formed from a single predetermined length of plastic tubing. In FIG. 4 there is illustrated a continuous length of tubing 20 which is supplied to a station where it is cut into predetermined lengths corresponding to the length of two of the end stops 30. It is to be understood that precut lengths of tubing could be used instead. As shown in FIG. 4 a pair of grippers 21 first come together to hold and position the tubing 20, and then move laterally as indicated by the arrows to advance the tubing 20 onto a guide rail 22. The tubing 20 is shown passing onto a rod-like guide rail that supports the tubing internally. However, the guide could take the form of a pipe-like member that supports the tubing externally if desired. The guide rail 22 is equipped with a blade 23, which may be heated, to slit the wall of the tubing 20 and to spread the slit as the tubing 20 travels along the guide rail 22. It is to be noted that the tubing 20 could alternatively be extruded in a pre-slit form if desired. When the grippers 21 fully advance the tubing 20 the predetermined distance, a reciprocating knife 24 cuts off the portion of the tubing 20 that is on the guide rail 22 providing the predetermined length needed for two end stops 30. The grippers 21 then open, as indicated by the arrow, and move back into position to adjust the next length of tubing 20 for the cutting operation.

Figure 5:
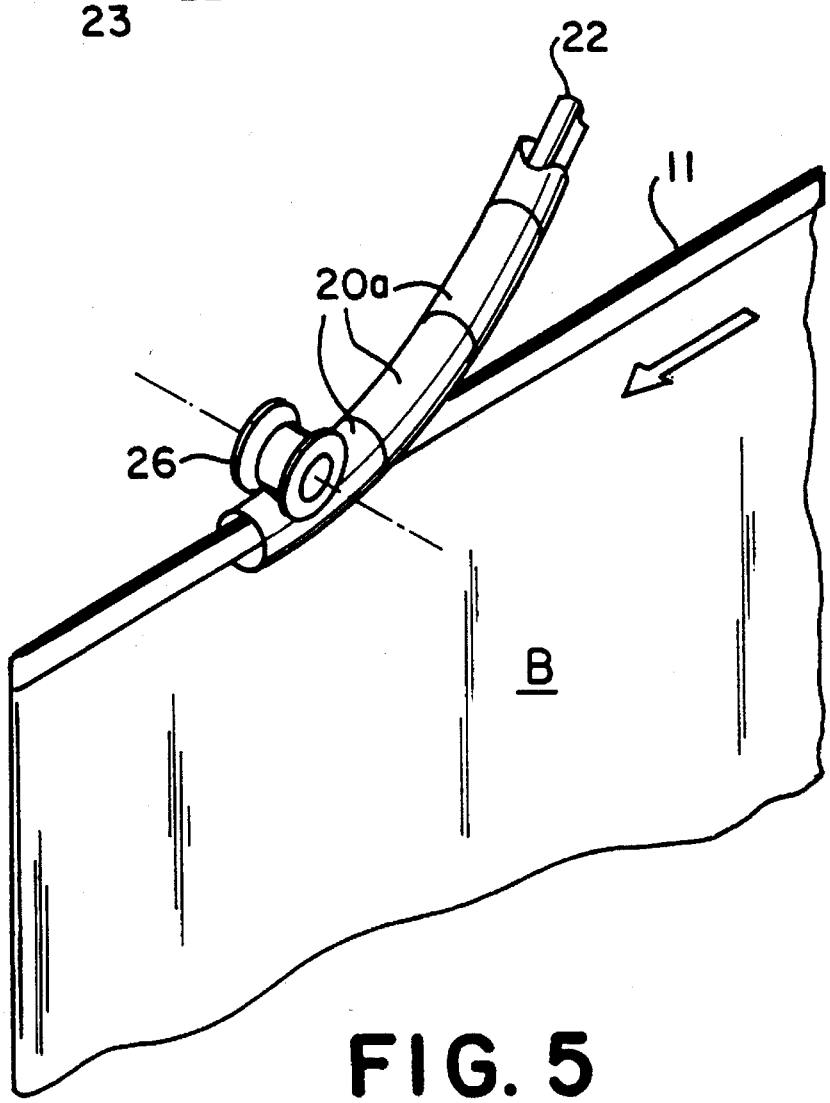
FIG. 5 is a perspective view illustrating the installation of the tubing onto zippers of bags for use as end stops in accordance with the present invention.

As may be seen in FIG. 5, the cut lengths of slit tubing **20*a* are collected on the guide rail 22 for delivery to an assembly station. Bag material B including a zipper profile 11 assembled thereon is likewise fed to the assembly station. The bag material including the zipper profile is typically fed from a continuous roll of the bag material to the assembly station. The direction of movement of the bag material is indicated by the arrow in FIG. 5. At the assembly station, one length 20*a* of the slit tubing is pushed off of the guide rail 22 onto the zipper profile 11 of the bag material by the length of tubing 20*a* that follows it as shown in FIG. 5. At the point where the cut length of tubing 20*a* exits the guide rail 22, its slit has been widened sufficiently so that it can pass over the interlocked profiles of the continuous zipper 11 on the bag material, which moves beneath it. The roller 26 in FIG. 5 aids in installing the slit length of tubing 20*a* on the zipper 11. Each length of tubing 20*a* is predetermined to serve as both clamps and end stops on the adjacent ends of two connected bags. As may be seen in FIGS. 1 and 3, there is provided a clamp-bonding station 25. At the clamp-bonding station 25, the predetermined length of tubing is positioned with respect to the separation line of the preceding bag, FIG. 1. The length of tubing is then locked into position on the profiles of the zipper 11 by features clamps 25*a*, 25*b* at the bonding station 25 that impress deformations through the wall of the tubing and into the zipper and bag profiles. The deformations that attach the end stops 30** can be made by compression along with either thermal or ultrasonic energy. The tubing wall simultaneously is narrowed or severed at the location where the edges of the bag will be heat-sealed and cut apart in a subsequent operation.

A combination tubular clamp and end stop 30 installed on the closure of a bag is shown in FIG. 2.

While a preferred embodiment of the invention has been described and illustrated, it is to be understood that further modifications thereof may be made within the scope of the appended claims without departing from the spirit of the invention.

What is claimed is:

1. In the manufacture of plastic-film bags having a reclosable fastener extending along the mouth of the bag and a slider straddling the fastener for opening and closing the fastener, the fastener comprising a pair of flexible plastic strips on facing sidewalls of the bag and having reclosable interlocking rib and groove profile elements on the respective strips, the improvement in end stops for the slider and in terminating the reclosable fastener comprising:

end stop means located at the opposite ends of the profile elements on the reclosable fastener, each of the end stop means comprising a length of slit plastic tubing extending over one end of the reclosable fastener and locked into position on the ends of the profile elements by bonding the tubing in sealed relation with the ends of the profile elements, each end stop including deformations impressed through the wall of the tubing and into the profile elements during bonding, said tubing projecting outwardly from said profile elements and being engageable with the slider for preventing the slider from moving past the ends of the reclosable fastener.

2. The improvement in end stops according to claim 1 wherein said deformations have been produced by thermal means.

3. The improvement in end stops according to claim 1 wherein the deformations have been produced by ultrasonic means.

* * * * *